US007644769B2

(12) United States Patent
Kobler et al.

(10) Patent No.: US 7,644,769 B2
(45) Date of Patent: Jan. 12, 2010

(54) METHOD OF COLLECTING HYDROCARBONS USING A BARRIER TUNNEL

(75) Inventors: Michael H. Kobler, Sebastopol, CA (US); Dana Brock, Sebastopol, CA (US)

(73) Assignee: OSUM Oil Sands Corp., Alberta (CA)

( * ) Notice: Subject to any disclaimer, the term of this patent is extended or adjusted under 35 U.S.C. 154(b) by 0 days.

(21) Appl. No.: 11/873,180

(22) Filed: Oct. 16, 2007

(65) Prior Publication Data

US 2008/0087422 A1 Apr. 17, 2008

Related U.S. Application Data

(60) Provisional application No. 60/829,599, filed on Oct. 16, 2006, provisional application No. 60/864,338, filed on Nov. 3, 2006.

(51) Int. Cl.
*E21B 43/16* (2006.01)
*E21B 43/08* (2006.01)

(52) U.S. Cl. ..... 166/369; 166/50; 299/2; 299/10

(58) Field of Classification Search ..... 166/369, 166/54.1, 166, 50, 263, 306, 250.03; 299/2, 299/10, 18, 19
See application file for complete search history.

(56) References Cited

U.S. PATENT DOCUMENTS 604,330 A 5/1898 Kibling
1,520,737 A 12/1924 Wright
1,660,187 A 2/1928 Ehrat
1,722,679 A 7/1929 Ranney
1,735,012 A 11/1929 Rich
1,735,481 A 11/1929 Uren
1,811,560 A 6/1931 Ranney
1,816,260 A 7/1931 Lee
1,852,717 A 4/1932 Grinnell et al.
1,884,859 A 10/1932 Ranney
1,910,762 A 5/1933 Grinnell et al.
1,936,643 A 11/1933 Reed
2,148,327 A 2/1939 Smith et al.
2,193,219 A 3/1940 Bowie et al.

(Continued)

FOREIGN PATENT DOCUMENTS

CA 986146 3/1976

(Continued)

OTHER PUBLICATIONS

"Thermal Recovery of Oil and Bitumen", Roger M. Butler, ISBN 0-9682563-0-9, 2nd Printing by GravDrain, Inc. Calgary, Alberta 1998.

(Continued)

*Primary Examiner*—Shane Bomar
(74) *Attorney, Agent, or Firm*—Sheridan Ross P.C.

(57) ABSTRACT

The present invention relates generally to a method and means of collecting oil from a reservoir overlying a water aquifer or basement rock using a manned tunnel. A manned tunnel is used as a physical barrier to intercept oil and water flowing downward along a formation dip and to preferentially collect the oil or the water through a series of collector stations. This method can be used for oil spill clean-ups or for hydrocarbon recovery in appropriate reservoirs.

32 Claims, 4 Drawing Sheets

U.S. PATENT DOCUMENTS

| | | | | |
|---|---|---|---|---|
| 2,200,665 | A | | 5/1940 | Bolton |
| 2,210,582 | A | | 8/1940 | Grosse et al. |
| 2,365,591 | A | | 12/1944 | Ranney |
| 2,670,801 | A | | 3/1954 | Sherborne |
| 2,783,986 | A | | 3/1957 | Nelson et al. |
| 2,786,660 | A | | 3/1957 | Alleman |
| 2,799,641 | A | | 7/1957 | Bell |
| 2,857,002 | A | | 10/1958 | Pevere et al. |
| 2,888,987 | A | | 6/1959 | Parker |
| 2,914,124 | A | | 11/1959 | Ripley, Jr. |
| 2,989,294 | A | | 6/1961 | Coker |
| 3,017,168 | A | | 1/1962 | Carr |
| 3,024,013 | A | | 3/1962 | Rogers et al. |
| 3,034,773 | A | | 5/1962 | Legatski |
| 3,207,221 | A | | 9/1965 | Cochran et al. |
| 3,227,229 | A | | 1/1966 | Wakefield, Jr. |
| 3,259,186 | A | | 7/1966 | Dietz |
| 3,285,335 | A | | 11/1966 | Reistle, Jr. |
| 3,333,637 | A | | 8/1967 | Prats |
| 3,338,306 | A | | 8/1967 | Cook |
| 3,353,602 | A | | 11/1967 | Geertsma |
| 3,386,508 | A | | 6/1968 | Bielstein et al. |
| 3,455,392 | A | | 7/1969 | Prats |
| 3,456,730 | A | | 7/1969 | Lange |
| 3,474,863 | A | | 10/1969 | Deans et al. |
| 3,530,939 | A | | 9/1970 | Turner et al. |
| 3,613,806 | A | | 10/1971 | Malott |
| 3,620,313 | A | | 11/1971 | Elmore et al. |
| 3,678,694 | A | | 7/1972 | Haspert |
| 3,768,559 | A | | 10/1973 | Allen et al. |
| 3,778,107 | A | | 12/1973 | Haspert |
| 3,784,257 | A | | 1/1974 | Lauber et al. |
| 3,838,738 | A | | 10/1974 | Redford et al. |
| 3,882,941 | A | | 5/1975 | Pelofsky |
| 3,884,261 | A | | 5/1975 | Clynch |
| 3,888,543 | A | | 6/1975 | Johns |
| 3,922,287 | A | | 11/1975 | Pawson et al. |
| 3,924,895 | A | | 12/1975 | Leasure |
| 3,937,025 | A | | 2/1976 | Alvarez-Calderon |
| 3,941,423 | A | | 3/1976 | Garte |
| 3,948,323 | A | | 4/1976 | Sperry et al. |
| 3,954,140 | A | | 5/1976 | Hendrick |
| 3,960,408 | A | | 6/1976 | Johns |
| 3,986,557 | A | | 10/1976 | Striegler et al. |
| 3,992,287 | A | | 11/1976 | Rhys |
| 4,046,191 | A | | 9/1977 | Neath |
| 4,055,959 | A | | 11/1977 | Fritz |
| 4,064,942 | A | * | 12/1977 | Prats ..... 166/303 |
| 4,067,616 | A | | 1/1978 | Smith et al. |
| 4,072,018 | A | | 2/1978 | Alvarez-Calderon |
| 4,076,311 | A | * | 2/1978 | Johns ..... 299/2 |
| 4,085,803 | A | | 4/1978 | Butler |
| 4,099,388 | A | | 7/1978 | Husemann et al. |
| 4,099,570 | A | | 7/1978 | Vandergrift |
| 4,099,783 | A | | 7/1978 | Verty et al. |
| 4,106,562 | A | | 8/1978 | Barnes et al. |
| 4,116,011 | A | | 9/1978 | Girault |
| 4,116,487 | A | | 9/1978 | Yamazaki et al. |
| 4,152,027 | A | | 5/1979 | Fujimoto et al. |
| 4,160,481 | A | | 7/1979 | Turk et al. |
| 4,165,903 | A | | 8/1979 | Cobbs |
| 4,167,290 | A | | 9/1979 | Yamazaki et al. |
| 4,203,626 | A | | 5/1980 | Hamburger |
| 4,209,268 | A | | 6/1980 | Fujiwara et al. |
| 4,216,999 | A | | 8/1980 | Hanson |
| 4,224,988 | A | | 9/1980 | Gibson et al. |
| 4,236,640 | A | | 12/1980 | Knight |
| 4,249,777 | A | | 2/1981 | Morrell et al. |
| 4,257,650 | A | | 3/1981 | Allen |
| 4,279,743 | A | | 7/1981 | Miller |
| 4,285,548 | A | | 8/1981 | Erickson |
| 4,289,354 | A | | 9/1981 | Zakiewicz |
| 4,296,969 | A | | 10/1981 | Willman |
| 4,406,499 | A | | 9/1983 | Yildirim |
| 4,434,849 | A | | 3/1984 | Allen |
| 4,440,449 | A | | 4/1984 | Sweeney |
| 4,445,723 | A | | 5/1984 | McQuade |
| 4,455,216 | A | | 6/1984 | Angevine et al. |
| 4,456,305 | A | | 6/1984 | Yoshikawa |
| 4,458,945 | A | * | 7/1984 | Ayler et al. ..... 299/2 |
| 4,458,947 | A | | 7/1984 | Hopley et al. |
| 4,463,988 | A | | 8/1984 | Bouck et al. |
| 4,486,050 | A | | 12/1984 | Snyder |
| 4,494,799 | A | | 1/1985 | Snyder |
| 4,502,733 | A | | 3/1985 | Grubb |
| 4,505,516 | A | | 3/1985 | Shelton |
| 4,533,182 | A | | 8/1985 | Richards |
| 4,536,035 | A | | 8/1985 | Huffman et al. |
| 4,575,280 | A | | 3/1986 | Hemphill et al. |
| 4,595,239 | A | * | 6/1986 | Ayler et al. ..... 299/2 |
| 4,601,607 | A | | 7/1986 | Lehmann |
| 4,603,909 | A | | 8/1986 | LeJeune |
| 4,607,888 | A | | 8/1986 | Trent et al. |
| 4,607,889 | A | | 8/1986 | Hagimoto et al. |
| 4,611,855 | A | | 9/1986 | Richards |
| 4,699,709 | A | | 10/1987 | Peck |
| 4,774,470 | A | | 9/1988 | Takigawa et al. |
| 4,793,736 | A | | 12/1988 | Thompson et al. |
| 4,808,030 | A | | 2/1989 | Takegawa |
| 4,856,936 | A | | 8/1989 | Hentschel et al. |
| 4,911,578 | A | | 3/1990 | Babendererde |
| 4,946,579 | A | | 8/1990 | Ocelli |
| 4,946,597 | A | | 8/1990 | Sury |
| 4,983,077 | A | | 1/1991 | Sorge et al. |
| 5,016,710 | A | | 5/1991 | Renard et al. |
| 5,032,039 | A | | 7/1991 | Hagimoto et al. |
| 5,051,033 | A | | 9/1991 | Grotenhofer |
| 5,125,719 | A | | 6/1992 | Snyder |
| 5,141,363 | A | | 8/1992 | Stephens |
| 5,174,683 | A | | 12/1992 | Grandori |
| 5,205,613 | A | | 4/1993 | Brown, Jr. |
| 5,211,510 | A | | 5/1993 | Kimura et al. |
| 5,217,076 | A | | 6/1993 | Masek |
| 5,255,960 | A | | 10/1993 | Ilomaki |
| 5,284,403 | A | | 2/1994 | Ilomaki |
| 5,316,664 | A | | 5/1994 | Gregoli et al. |
| 5,330,292 | A | | 7/1994 | Sakanishi et al. |
| 5,339,898 | A | | 8/1994 | Yu et al. |
| 5,354,359 | A | | 10/1994 | Wan et al. |
| 5,446,980 | A | | 9/1995 | Rocke |
| 5,472,049 | A | * | 12/1995 | Chaffee et al. ..... 166/250.1 |
| 5,484,232 | A | | 1/1996 | Hayashi et al. |
| 5,534,136 | A | | 7/1996 | Rosenbloom |
| 5,534,137 | A | | 7/1996 | Griggs et al. |
| 5,655,605 | A | * | 8/1997 | Matthews ..... 166/370 |
| 5,697,676 | A | | 12/1997 | Kashima et al. |
| 5,767,680 | A | * | 6/1998 | Torres-Verdin et al. ..... 324/355 |
| 5,785,736 | A | | 7/1998 | Thomas et al. |
| 5,831,934 | A | | 11/1998 | Gill et al. |
| 5,852,262 | A | | 12/1998 | Gill et al. |
| 5,879,057 | A | | 3/1999 | Schwoebel et al. |
| 5,890,771 | A | | 4/1999 | Cass |
| 6,003,953 | A | | 12/1999 | Huang et al. |
| 6,017,095 | A | | 1/2000 | DiMillo |
| 6,027,175 | A | | 2/2000 | Seear et al. |
| 6,206,478 | B1 | | 3/2001 | Uehara et al. |
| 6,257,334 | B1 | | 7/2001 | Cyr et al. |
| 6,263,965 | B1 | | 7/2001 | Schmidt et al. |
| 6,277,286 | B1 | * | 8/2001 | Søntvedt et al. ..... 166/250.03 |
| 6,364,418 | B1 | | 4/2002 | Schwoebel |
| 6,412,555 | B1 | * | 7/2002 | Sten-Halvorsen et al. ..... 166/250.03 |
| 6,554,368 | B2 | | 4/2003 | Drake et al. |
| 6,569,235 | B2 | | 5/2003 | Carter, Jr. |

| | | | | |
|---|---|---|---|---|
| 6,604,580 | B2 | 8/2003 | Zupanick et al. | |
| 6,631,761 | B2 | 10/2003 | Yuan et al. | |
| 6,679,326 | B2 | 1/2004 | Zakiewicz | |
| 6,758,289 | B2 | 7/2004 | Kelley et al. | |
| 6,796,381 | B2 | 9/2004 | Ayler et al. | |
| 6,857,487 | B2 | 2/2005 | Galloway et al. | |
| 6,869,147 | B2 | 3/2005 | Drake et al. | |
| 6,880,633 | B2 | 4/2005 | Wellington et al. | |
| 6,929,330 | B2 | 8/2005 | Drake et al. | |
| 6,997,256 | B2 * | 2/2006 | Williams et al. | 166/250.03 |
| 7,066,254 | B2 | 6/2006 | Vinegar et al. | |
| 7,097,255 | B2 | 8/2006 | Drake et al. | |
| 7,128,375 | B2 | 10/2006 | Watson | |
| 7,185,707 | B1 * | 3/2007 | Graham | 166/371 |
| 7,192,092 | B2 | 3/2007 | Watson | |
| 7,448,692 | B2 | 11/2008 | Drake et al. | |
| 2004/0211559 | A1 | 10/2004 | Nguyen et al. | |
| 2005/0051362 | A1 | 3/2005 | McGuire et al. | |
| 2006/0065393 | A1 * | 3/2006 | Williams et al. | 166/250.03 |
| 2007/0039729 | A1 * | 2/2007 | Watson et al. | 166/245 |
| 2007/0044957 | A1 * | 3/2007 | Watson et al. | 166/245 |
| 2007/0085409 | A1 | 4/2007 | Drake et al. | |
| 2008/0017416 | A1 * | 1/2008 | Watson et al. | 175/62 |
| 2008/0078552 | A1 | 4/2008 | Donnelly et al. | |
| 2008/0122286 | A1 | 5/2008 | Brock et al. | |

FOREIGN PATENT DOCUMENTS

| | | |
|---|---|---|
| CA | 986544 | 3/1976 |
| CA | 1165712 | 4/1984 |
| CA | 1167238 | 5/1984 |
| CA | 2124199 | 6/1992 |
| CA | 2222668 | 5/1998 |
| CA | 2340506 | 9/2001 |
| CA | 2526854 | 9/2001 |
| CA | 2583508 | 9/2001 |
| CA | 2583513 | 9/2001 |
| CA | 2583519 | 9/2001 |
| CA | 2583523 | 9/2001 |
| CA | 2358805 | 10/2001 |
| CA | 2315596 | 2/2002 |
| CA | 2332207 | 2/2002 |
| JP | 03-267497 | 11/1991 |
| WO | WO 01/69042 | 9/2001 |

OTHER PUBLICATIONS

Kieways, The Magazine of Peter Klewit Sons', Inc., Jan.-Feb.-Mar. 2006 (34 pages).

"High-Strength Concrete at High Temperature—An Overview", Long T. Phan, National Institute of Standards and Technology, Gaithersburg, Maryland.

"Steam Assisted Gravity Drainage (SAGD): A New Oil Production Technology for Heavy Oil and Bitumens", T.N. Nasr, CSEG Recorder, Alberta Research Council, Calgary, Canada, Mar. 2003.

"Wet Electric Heating for Starting Up SAGD/VAPEX", Yuan, Huang, Mintz, Wang, Jossy, Tunney, Alberta Research Council, Presented at the Petroleum Society's 5th Canadian International Petroleum Conference, Calgary, Alberta, Jun. 2004.

"Lateral Extension for Toronto's Metro", Tunnels & Tunnelling International, Mar. 1998, pp. 46-49.

Eric P. Kindwall and Dana Brock, "Successful Use of Oxygen Decompression in Compressed Air Caisson Work", undated.

Claus Becker, "Chapter 48: Recent Application of Slurry- and EPB-Technique in Europe", 1999 RETC Proceedings, pp. 857-864.

J.H.L. Palmer et al., "Performance of a 7.6-m Diameter Full-Face Tunnel-Boring Machine Designed for a Canadian Coal Mine", pp. 203-208, undated.

Shani Wallis, "Canadian Coal Given the TBM Treatment at Cape Breton", Tunnels & Tunnelling, May 1985, 4 pages.

J. Coady Marsh et al., "Chapter 11: Design, Excavation, Support of a Large Diameter Coal Mine Access Decline Using a Tunnel Boring Machine", 1985 RETC Proceedings, vol. 1, pp. 155-176.

George A. Peer, "Giant Rock TMB to Drive Access Tunnels Under Ocean", Heavy Construction News, Sep. 19, 1983, 2 pages.

J.A. Hunter and R. Lovat, "Design, Development, and Verification of a Lovat 7.6-metre Full-Face Tunnel-Boring Machine", CIM Coal Developments, undated, 8 pages.

A.W. Stokes and D.B. Stewart, "Cutting Head Ventilation for a Full Face Tunnel Boring Machine", Cape Breton Coal Research Laboratory, CANMET, Sydney, Canada, undated, pp. 305-311.

"Versatile Lovat Picked for Jubilee Line", Tunnels & Tunnelling, Sep. 1994, 1 page.

"Jubilee Line Meets the Challenge", undated, 2 pages.

Simon Walker, "One Year Down the Jubilee Line", World Tunnelling, Feb. 1995, 4 pages.

Shani Wallis, "London's JLE Experience With Closed-Face Soft-Ground Pressurised TBMs", Tunnel, Feb. 1998, 4 pages.

George A. Peer, "Rock 'n' Roll Goes Underground", Heavy Construction News, Oct. 1997, pp. 12-13.

Steve Skelhorn et al., "North American Focus: Partnering in Toronto", World Tunnelling and Subsurface Excavation, Dec. 1998, 4 pages.

B. Garrod and R. Delmar, "Earth Pressure Balance TBM Performance—A Case Study", undated, pp. 41-50.

"A New TBM Saves Critical Deadline at Cleuson-Dixence Switzerland", Tunnels & Tunnelling, undated, 4 pages.

U.S. Appl. No. 12/237,163, filed Sep. 24, 2008, Gil.

Harris, et al., "Feasibility of Underground Mining of Oil Sand", Alberta Oil Sands Information Center, 1978, pp. 1-33.

O'Rourke, et al., "AOSTRA's Underground Test Facility (UTF): Mine-Assisted Recovery Under Difficult Conditions", CIM Bulletin, Jan. 1989, pages unknown, vol. 82., No. 921.

Stephenson et al., "Mining Aspects Of Hard To Access Oil Sands Deposits", Norwest Corporation, Mar. 2, 2006, pp. 1-57.

Deutsch et al., "Guide To SAGD (Steam Assisted Gravity Drainage) Reservoir Characterization Using Geostatistics", Centre for Computational Geostatistics (CCG) Guidebook Series vol. 3, 2005 (27 pages).

Author Unknown, "Technical Overview: Nigeria's Bitumen Belt And Developmental Potential", Ministry of Solid Minerals Development, Mar. 6, 2006, Available at http://64.233.167.104/search?q_cache:m12yiQ5o16EJ:msmd.gov.ng/privatisation/docs/Bitu men%2520Overview.pdf+SAGD+a..., printed Jan. 10, 2007, pp. 1-48.

Piper, et al., "An Evaluation of Heavy Oil Mining", Energy Development Consultants,, Inc. and Stone Webster Engineering Corp., Department of Energy Contract No. DE-AC03-80PC30259, Dec. 1982, pp. 1-270.

Hutchins, et al., "Mining for Petroleum: Feasibility Study", Energy Development Consultants, Inc., US Bureau of Mines Contract No. JO275002, Jul. 1978, pp. 1-365.

Author Unknown, "Future of Oil Recovery from Underground Drill Sites", Underground Technology Research Council, Committee of Mine Assisted Oil Recovery, Dec. 1988, pp. 1-51.

Fontaine, et al., "An Evaluation of Oil Mining in Ohio Phase II", Sep. 1983, pp. 1-58.

Fontaine, et al., "Recommended Reservoir Engineering Testing Program for Oil Mining Projects", Jan. 1984, pp. 1-140.

Riddell, "Oil Mining A Review of Projects", Jun. 1984, pp. 1-32.

Hutchins, et al., "Oil Mining: An Emerging Technology", Wassum Mining Engineering, Dec. 1981, pp. 1-4.

Dick, et al., "Oil Mining", U.S. Bureau of Mines, 1980, pp. 1-6.

Dobson, et al., "Mining Technology Assists Oil Recovery from Wyoming Field", Journal of Petroleum Technology, from Soc. Pet. Eng., Apr. 1981, pp. 1-7.

Author Unknown, "Oil Mining: The Fourth Order of Oil Recovery", Compressed Air Magazine, Dec. 1983, pp. 6-10.

Riddell, et al., "Heavy Oil Mining Technical and Economic Analysis", Presented at California Regional Meeting of the Society of Petroleum Engineers, Long Beach, CA Apr. 11-13, 1984, pp. 1-24.

Author Unknown, Lovat Inc. Company Brochure, date unknown, pp. 1-22.

Author Unknown, "Sunburst Excavation", In Focus, Nov. 1993, pp. 18-19, 22-23.

Hignett et al.; "Tunnelling Trials in Chalk: Rock Cutting Experiments"; TRRL Laboratory Report 796; 1977.
Ozdemir, et al., "Development of a Water Jet Assisted Drag Bit cutting Head for Coal Measure Rock" Chapter 41, RETC Proceedings, vol. 2, 1983, pp. 701-718.
Wang, et al.; "High Pressure Water Jet Assisted Tunnelling" Chapter 34, 1976 RETC Proceedings, pp. 649-676.
McCormick, et al., "Analysis of TBM Performance at the Record Setting River Mountains Tunnel #2", Chapter 8, 1997 RETC Proceedings, pp. 135-149.
Maciejewski, "Hydrotransport—An Enabling Technology for Future Oil Sands Development" Syncrude Canada Ltd., pp. 67-79.
Paine, et al., "Understanding hydrotransport: The key to Syncrude's success", CIM Bulletin, vol. 92, 1999, pp. 105-108.
Mikula et al., "Oil Sands Conditioning, Bitumen Release Mechanisms, and New Process Development", Albert Oil Sands Information Services, 1999, pp. 1-8.
Mikula et al., "Commercial Implementation of a Dry Landscape Oil Sands Tailings Reclamation Option: Consolidated Tailings", Alberta Oil Sands Information Services; No. 1998.096, dated unknown, pp. 907-921.
Friesen et al., "Monitoring of Oil Sand Slurries by On-line NIR Spectroscopy", Petroleum Society of CIM & Aostra, paper No. 94.10, date unknown, pp. 1-9.
Liu, et al.; "Volume reduction of oil sands fine tails utilizing nonsegregating tailings", Tailings and Mine Waste '96, pp. 73-81.
Matthews, et al., "Development of composite tailings technology at Syncrude Canada", Syncrude EDM Research, 2000, pp. 455-463.
Yoshidawa, et al., "A Study of Shield Tunnelling Machine (Part 1)—Soil Condition for Pressurized Slurry Shield to be Adapted-", Translation Copy of Hitachi Zosen Technical Review, vol. 42, No. 1-4, 1981, pp. 1-41.
Author Unknown, "Mitsubishi Shield Machine", Mitsubishi Heavy Industries, Ltd., date unknown, pp. 1-38.
Czarnecki, Press Release; NSERC Industrial Research Chair in Oil Sands Syncrude Canada, Ltd, date unknown, pp. 1-3.
Canadian Heavy Oil Associate (CHOA) Annual Conference, Dec. 6, 2000, presentation by Oil Sands Underground Mining, Inc.
Stack, "Handbook of Mining and Tunneling Machinery", 1982, pp. 283 and 311.
Young,et al., "Full-scale Testing of the PCF Rock Excavation Method", VII Australian Tunelling Conference, Aug. 1993 pp. 259-264.
Babendererde, et al., "Extruded Concrete Lining—The Future Lining Technology for Industrialized Tunnelling," 2001 RETC Proceedings, Chapter 55, pp. 679-685.
Becker, "The Choice Between EPB- and Slurry Shields: Selection Criteria by Practical Examples," 1995 RETC Proceedings, Chapter 31, pp. 479-492.
Becker, "The Fourth Tube of the Elbe-Tunnel—Built by the World's Largest Soft Ground Tunnelling Machine", 2001 RETC Proceedings, Chapter 17, pp. 182-186.
Bergling, et al., "Main Bearings for Advanced TBMS," 1995 RETC Proceedings, Chapter 32, pp. 493-508.
Corti, et al., "Athabasca Mineable Oil Sands: The RTR/Gulf Extraction Process Theoretical Model of Bitumen Detachment," The 4.sup. th UNITAR/UNDP International Conference on Heavy Crude and Tar Sands Proceedings, vol. 5, Edmonton, AB, Aug. 7-12, 1988, pp. 41-44, 71.
Funasaki, et al., "World's Largest Slurry Shield Tunneling Report in Trans-Tokyo Bay Highway Construction," 1997 RETC Proceedings, Chapter 36, pp. 591-604.
Guetter, et al., "Two Tunnels in Totally Different Geological Formations Driven by the Same 7M Double-Shield TMB with an Extremely Thin-Walled Monoshell Honeycomb Segmental Lining System," 2001 RETC Proceedings, Chapter 21, pp. 241-260.
Herrenknecht, et al., "The New Generation of Soft Ground Tunnelling Machines," 1999 RETC Proceedings, Chapter 36, pp. 647-663.
Author Unknown, "Improving Profitability With New Technology," Joint Paper Between Petrel Robertson and Oil Sands Underground Mining, Inc., Edmonton, Alberta, Sep. 2001, pp. 1-44.
Jacobs, et al., "Hydrogen Sulfide Controls for Slurry Shield Tunneling in Gassy Ground Conditions—A Case History," 1999 RETC Proceedings, pp. 221-239.
Marcheselli, et al., "Construction of the 'Passante Ferroviario' Link in Milano, Lots 3P—5P—6P Excavation by Large Earth Pressure Balanced Shield with Chemical Foam Injection," 1995 RETC Proceedings, Chapter 36, pp. 549-572.
Moulton, et al., "Tunnel Boring Machine Concept for Converging Ground," 1995 RETC Proceedings, Chapter 33, pp. 509-523.
Author Unknown, "Underground Mining of Oil Sands," Oil Sands Underground Mining, Inc., presented at National Oil Sands Task Force, Jan. 2001 Quarterly Meeting, pp. 1-38.
Author Unknown, "A New Technology for the Recovery of Oil Sands," Oil Sands Underground Mining, Inc., presented at combined Oil Sands Task Force and Black Oil Pipeline Network Meeting, Jun. 2001, pp. 1-30.
Oil Sands Underground Mining, Inc., "A Private Sector Approach to Design/Build," presented at NAT 2002, 34 pages.
Richards, et al., "Slurry Shield Tunnels on the Cairo Metro," 1997 RETC Proceedings, Chapter 44, pp. 709-733.
Rose, "Steel-Fiber-Reinforced-Shotcrete for Tunnels: An International Update," 1999 RETC Proceedings, pp. 525-536.
Sager, "Underpassing the Westerschelde by Implementing New Technologies," 1999 RETC Proceedings, pp. 927-938.
Uchiyama, "Twin TBM with Four Cutters for Subway Station (Roppongi Station in the Tokyo Metro Line 12)," 1999 RETC Proceedings, Chapter 37, pp. 665-674.
Wu, et al., "Stress Analysis and Design of Tunnel Linings," Chapter 26, pp. 431-455.
Borm, "Integrated Seismic Imaging System for Geological Prediction Ahead in Underground Construction," 2001 RETC Proceedings, Chapter 22, pp. 263-271.
Dowden, et al., "Coping with Boulders in Soft Ground TBM Tunneling," 2001 RETC Proceedings, Chapter 78, pp. 961-977.
Doyle, et al., "Construction of Tunnels in Methane Environments," 1991 RETC Proceedings, Chapter 12, pp. 199-224.
Drake, et al., "A Promising New Concept for Underground Mining of Oil Sands," technical papers presented to Canadian Institute of Mining (CIM), Ft. McMurray, Jun. 13-15, 2001, pp. 1-16.
Drake, "An Innovative Approach for the Underground Mining of Oil Sands," presented at North American Tunneling 2002, Seattle, WA May 2002 and NARMS-TAC 202, Mining and Tunneling Innovation and Opportunity Conference, Toronto, Ontario, Jul. 2002, pp. 1-8.
Higashide, et al., "Application of DOT Tunneling Method to Construction of Multi-Service Utility Tunnel Adjacent to Important Structures," 1995 RETC Proceedings, Chapter 34, pp. 527-541.
Ounanian, et al., "Development of an Extruded Tunnel Lining System" Chapter 81, 1981 RETC Proceedings, vol. 2, pp. 1333-1351.
Schenk, "Recent Developments in High-Pressure Water-Jet Assisted Cutting of Rock and Coal", The Pennsylvania State University, RETC Proceedings, vol. 2, Chapter 39, 1983, pp. 663-684.
Zink, et al., "Water Jet Uses in Sandstone Excavation", RETC Proceedings, vol. 2, Chapter 40, 1983, pp. 685-700.
Souder, et al. "Water Jet Coal Cutting: The Resurgence Of An Old Technology", RETC Proceedings, vol. 2, Chapter 42, 1983, pp. 719-739.
Li, et al., "Prediction of Oil Production by Gravity Drainage", Stanford University, SPE 84 184, Oct. 2003, pp. 1-8.
Harris, et al., "Feasbility of Underground Mining of Oil Sand", Alberta Oil Sands Information Center, 1978, pp. 1-33.
O'Rourke, et al., "AOSTRA's Underground Test Facility (UTF): Mine-Assisted Recovery Under Difficult Conditions", CIM Bulletin, Jan. 1989, pages unknown, vol. 82, No. 921.
Background of the invention for the above captioned application (previously provided).
"Plan of Operation, Shell Frontier Oil and Gas Inc., E-ICP Test Project", Oil Shale Research and Development Project, Prepared for Bureau of Land Management, Feb. 15, 2006, pp. 1-70.
Background of the invention for the above captioned application (previously provided).

Sahni, et al., "Electromagnetic Heating Methods for Heavy Oil Reservoirs", Submitted to 2000 Society of Petroleum Engineers, SPE/AAPG Western Regional Meeting, May 1, 2000, Long Beach, CA, pp. 1-12.

Background of the invention for the above captioned application (previously provided).

International Preliminary Report on Patentability for International (PCT) Patent Application No. PCT/US07/81531, issued Apr. 22, 2009.

Hardy, "Feasibility Study for Underground Mining of Oil Sand", Department of Energy, Mines and Resources, Canada, Sep. 1977, pp. 1-314.

International Search Report for International (PCT) Patent Application No. PCT/US07/81531, mailed Aug. 5, 2008.

Written Opinion for International (PCT) Patent Application No. PCT/US07/81531, mailed Aug. 5, 2008.

Cardwell, W.T. and Parsons, R.L., "Gravity Drainage Theory", Trans. AIME 179, 199-211 (1949).

Terwilliger, P.L., Wilsey, L.E., Hall, H.N., Bridges, P.M. and Moise, R.A., "An Experimental and Theoretical Investigation of Gravity Drainage Performance", Trans. AIME 146,28-53 (1951 ).

Dykstra, H., "The Prediction of Oil Recovery by Gravity Drainage", IPT, 818-830 (May 1978).

Kewen et al. "Prediction of Production by Gravity Drainage", Stanford University, SPE 84 184, Oct. 2003.

Sahni, et al, "Electromagnetic Heating Methods for Heavy Oil Reservoirs", Submitted to 2000 Society of Petroleum Engineers, SPE/AAPG Western Regional Meeting, May 1, 2000, Long Beach, CA, pp. 1-12.

Background of the invention for the above captioned application (previously provided).

"Plan of Operation, Shell Frontier Oil and Gas Inc., E-ICP Test Project", Oil Shale Research and Development Project, Prepared for Bureau of Land Management, Feb. 15, 2006, pp. 1-70.

Background of the invention for the above captioned application (previously provided).

* cited by examiner

METHOD OF COLLECTING HYDROCARBONS USING A BARRIER TUNNEL

CROSS REFERENCE TO RELATED APPLICATION

The present application claims the benefits, under 35 U.S.C. §119(e), of U.S. Provisional Applications Ser. No. 60/829,599 filed Oct. 16, 2006, entitled "Method of Collecting Hydrocarbons Using a Barrier Tunnel" to Brock and Kobler and Ser. No. 60/864,338 filed Nov. 3, 2006, entitled "Method of Collecting Hydrocarbons Using a Barrier Tunnel" to Brock and Kobler, both of which are incorporated herein by these references.

Cross reference is made to U.S. patent application Ser. No. 11/441,929 filed May 25, 2006, entitled "Method for Underground Recovery of Hydrocarbons", which is also incorporated herein by this reference.

FIELD

The present invention relates generally to a method and means of collecting oil from a reservoir overlying a water aquifer or basement rock using a manned tunnel.

BACKGROUND

There are situations where oil in the ground overlies water or a basement rock and can be recovered by unconventional means.

An example of such a situation is a layer of light oil overlying water in a shallow loose or lightly cemented sand deposit. For example, if the sand is a sand dune area adjacent to a large body of water such as a lake or an ocean, the layer of oil can be formed by an oil spill which collects and floats on the water table but under the surface of the sand dune. The oil spill can result, for example, from a breach or leak in an underground pipeline that goes undetected for a period of time.

Another example of such a situation is a layer of heavy oil or bitumen in a shallow lightly cemented oil sand deposit overlying either a layer of water or lying directly on a basement rock. Such situations occur in many shallow heavy oil or bitumen deposits (that is, oil sands deposits under no more than a few hundred meters of overburden). In some cases, production of heavy oil by cold flow may be feasible. In other cases, the heavy oil or bitumen may have to be mobilized by injection of steam or diluent.

While it may be possible to drill wells from the surface or to strip off the overburden to recover the hydrocarbon of interest, there may be surface restrictions preventing these approaches. For example, the hydrocarbon deposit may be under a lake, a river valley, a town, a protected wildlife habitat, a national park or the like.

There remains, therefore, a need for a method and means to recover the oil from above the underlying aquifer or basement rock by methods that minimize surface disturbance.

SUMMARY

These and other needs are addressed by the present invention. The various embodiments and configurations of the present invention are directed generally to installing a lined barrier excavation, preferably straddling a liquid hydrocarbon/water interface, where the tunnel forms a physical barrier along all or a substantial portion of the length of the liquid hydrocarbon deposit and can collect the liquid hydrocarbon.

In a first embodiment of the present invention, a method for recovering a liquid hydrocarbon is provided that includes the steps:

(a) forming a barrier excavation along a substantial length of a subsurface liquid hydrocarbon-water interface;

(b) positioning a liner in the excavation, the liner being substantially impervious to the passage of the liquid hydrocarbon and water;

(c) forming a plurality of recovery ports at selected intervals along a length of the tunnel liner, the recovery ports passing through the liner and being in communication with an external subsurface formation; and (d) recovering a portion of the liquid hydrocarbon through at least some of the recovery ports.

In a second embodiment, a system for removing a liquid hydrocarbon includes:

(a) a tunnel extending along a length of a subsurface interface between a liquid hydrocarbon and water;

(b) a liner positioned in the tunnel, the liner being substantially impervious to the passage of liquid hydrocarbons and water; and (c) a plurality of recovery ports at selected intervals along a length of the tunnel liner, the recovery ports passing through the liner and being in communication with an external subsurface formation comprising the liquid hydrocarbon and water.

In one configuration, each of the recovery ports includes a first section comprising a main shut off valve and one or more additional sections comprising at least one of a viewing port to determine visually a type and/or composition of fluid entering the port; a sampling tap to collect a sample of a recovered fluid; and a sensor to determine, by measurement, a type and/or composition of the fluid entering the port.

In another embodiment, a method is provided that includes the steps of:

(a) providing a barrier excavation along a substantial length of a subsurface a liquid hydrocarbon-water interface, the barrier excavation comprising a liner in the excavation, the liner being substantially impervious to the passage of the liquid hydrocarbon and water, and a plurality of recovery ports at selected intervals along a length of the tunnel liner, the recovery ports passing through the liner and being in communication with an external subsurface formation; and (b) at a first time interval, selecting a first set of recovery ports positioned at a first location along the tunnel;

(c) determining which of members of the first set of recovery ports are currently in communication with the liquid hydrocarbon and which of members of the first set are not currently in communication with the liquid hydrocarbon; and (d) opening the members of the first set of recovery ports that are currently in communication with the liquid hydrocarbon and not the members of the first set of recovery ports that are not currently in communication with the liquid hydrocarbon.

In one configuration, the tunnel has numerous ports installed in the side of the liner to which the oil flows toward as it migrates downward along the approximate dip of the formation. These ports can be independently operated to preferentially drain off the oil and collect the oil in a controlled manner for recovery.

The tunnel can also be used for biosparging, which is blowing air or oxygen at low flow rate into the water below the oil to "polish" remaining low concentrations of hydrocarbons by (1) giving oil-eating bacteria oxygen an opportunity to work and (2) volatilizing light fractions. If the air or oxygen is blown at a high enough pressure and/or flow rate, it can strip out the hydrocarbon by volatilization. This technique is called air-sparging. In some cases, bio-sparging would be the preferred technique while in others air-sparging would be the preferred technique.

The following definitions are used herein:

"A" or "an" entity refers to one or more of that entity. As such, the terms "a" (or "an"), "one or more" and "at least one" can be used interchangeably herein. It is also to be noted that the terms "comprising", "including", and "having" can be used interchangeably.

In geology, the dip includes both the direction of maximum slope pointing down a bedding plane, which may be a bedding plane within the formation of interest or the basement rock on which the formation of interest lies, and the angle between the maximum slope and the horizontal. A water table within a formation of interest may also have a dip.

A hydrocarbon is an organic compound that includes primarily, if not exclusively, of the elements hydrogen and carbon. Hydrocarbons generally fall into two classes, namely aliphatic, or straight chain, hydrocarbons, cyclic, or closed ring, hydrocarbons, and cyclic terpenes. Examples of hydrocarbon-containing materials include any form of natural gas, oil, coal, and bitumen that can be used as a fuel or upgraded into a fuel. Hydrocarbons are principally derived from petroleum, coal, tar, and plant sources.

Hydrocarbon production or extraction refers to any activity associated with extracting hydrocarbons from a well or other opening. Hydrocarbon production normally refers to any activity conducted in or on the well after the well is completed. Accordingly, hydrocarbon production or extraction includes not only primary hydrocarbon extraction but also secondary and tertiary production techniques, such as injection of gas or liquid for increasing drive pressure, mobilizing the hydrocarbon or treating by, for example chemicals or hydraulic fracturing the well bore to promote increased flow, well servicing, well logging, and other well and wellbore treatments.

A liner as defined for the present invention is any artificial layer, membrane, or other type of structure installed inside or applied to the inside of an excavation to provide at least one of ground support, isolation from ground fluids (any liquid or gas in the ground), and thermal protection. As used in the present invention, a liner is typically installed to line a shaft or a tunnel, either having a circular or elliptical cross-section. Liners are commonly formed by pre-cast concrete segments and less commonly by pouring or extruding concrete into a form in which the concrete can solidify and attain the desired mechanical strength.

A liner tool is generally any feature in a tunnel or shaft liner that self-performs or facilitates the performance of work. Examples of such tools include access ports, injection ports, collection ports, attachment points (such as attachment flanges and attachment rings), and the like.

A manned excavation refers to an excavation that is accessible directly by personnel. The manned excavation can have any orientation or set of orientations. For example, the manned excavation can be an incline, decline, shaft, tunnel, stope, and the like. A typical manned excavation has at least one dimension normal to the excavation heading that is at least about 1.5 meters.

A mobilized hydrocarbon is a hydrocarbon that has been made flowable by some means. For example, some heavy oils and bitumen may be mobilized by heating them or mixing them with a diluent to reduce their viscosities and allow them to flow under the prevailing drive pressure. Most liquid hydrocarbons may be mobilized by increasing the drive pressure on them, for example by water or gas floods, so that they can overcome interfacial and/or surface tensions and begin to flow. Bitumen particles may be mobilized by some hydraulic mining techniques using cold water.

Primary production or recovery is the first stage of hydrocarbon production, in which natural reservoir energy, such as gasdrive, waterdrive or gravity drainage, displaces hydrocarbons from the reservoir, into the wellbore and up to surface. Production using an artificial lift system, such as a rod pump, an electrical submersible pump or a gas-lift installation is considered primary recovery. Secondary production or recovery methods frequently involve an artificial-lift system and/or reservoir injection for pressure maintenance. The purpose of secondary recovery is to maintain reservoir pressure and to displace hydrocarbons toward the wellbore. Tertiary production or recovery is the third stage of hydrocarbon production during which sophisticated techniques that alter the original properties of the oil are used. Enhanced oil recovery can begin after a secondary recovery process or at any time during the productive life of an oil reservoir. Its purpose is not only to restore formation pressure, but also to improve oil displacement or fluid flow in the reservoir. The three major types of enhanced oil recovery operations are chemical flooding, miscible displacement and thermal recovery.

A seal is a device or substance used in a joint between two apparatuses where the device or substance makes the joint substantially impervious to or otherwise substantially inhibits, over a selected time period, the passage through the joint of a target material, e.g., a solid, liquid and/or gas. As used herein, a seal may reduce the in-flow of a liquid or gas over a selected period of time to an amount that can be readily controlled or is otherwise deemed acceptable. For example, a seal between sections of a tunnel may be sealed so as to (1) not allow large water in-flows but may allow water seepage which can be controlled by pumps and (2) not allow large gas in-flows but may allow small gas leakages which can be controlled by a ventilation system.

Steam flooding as used herein means using steam to drive a hydrocarbon through the producing formation to a production well.

Steam stimulation as used herein means using steam to heat a producing formation to mobilize the hydrocarbon in order to allow the steam to drive a hydrocarbon through the producing formation to a production well.

A tunnel is a long approximately horizontal underground opening having a circular, elliptical or horseshoe-shaped cross-section that is large enough for personnel and/or vehicles. A tunnel typically connects one underground location with another.

An underground workspace as used in the present invention is any excavated opening that is effectively sealed from the formation pressure and/or fluids and has a connection to at least one entry point to the ground surface.

A well is a long underground opening commonly having a circular cross-section that is typically not large enough for personnel and/or vehicles and is commonly used to collect and transport liquids, gases or slurries from a ground formation to an accessible location and to inject liquids, gases or slurries into a ground formation from an accessible location.

A wellhead consists of the pieces of equipment mounted at the opening of the well to regulate and monitor the extraction of hydrocarbons from the underground formation. It also prevents leaking of oil or natural gas out of the well, and prevents blowouts due to high pressure formations. Formations that are under high pressure typically require wellheads that can withstand a great deal of upward pressure from the escaping gases and liquids. These wellheads must be able to withstand pressures of up to 20,000 psi (pounds per square inch). The wellhead consists of three components: the casing head, the tubing head, and the 'christmas tree'. The casing head consists of heavy fittings that provide a seal between the casing and the surface. The casing head also serves to support the entire length of casing that is run all the way down the well. This piece of equipment typically contains a gripping mechanism that ensures a tight seal between the head and the casing itself.

Wellhead control assembly as used in the present invention joins the manned sections of the underground workspace with and isolates the manned sections of the workspace from the well installed in the formation. The wellhead control assembly can perform functions including: allowing well drilling, and well completion operations to be carried out under formation pressure; controlling the flow of fluids into or out of the well, including shutting off the flow; effecting a rapid shutdown of fluid flows commonly known as blow out prevention; and controlling hydrocarbon production operations.

It is to be understood that a reference to oil herein is intended to include low API hydrocarbons such as bitumen (API less than ~10°) and heavy crude oils (API from ~10° to ~20°) as well as higher API hydrocarbons such as medium crude oils (API from ~20° to ~35°) and light crude oils (API higher than ~35°).

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

DETAILED DESCRIPTION

Figure 1:
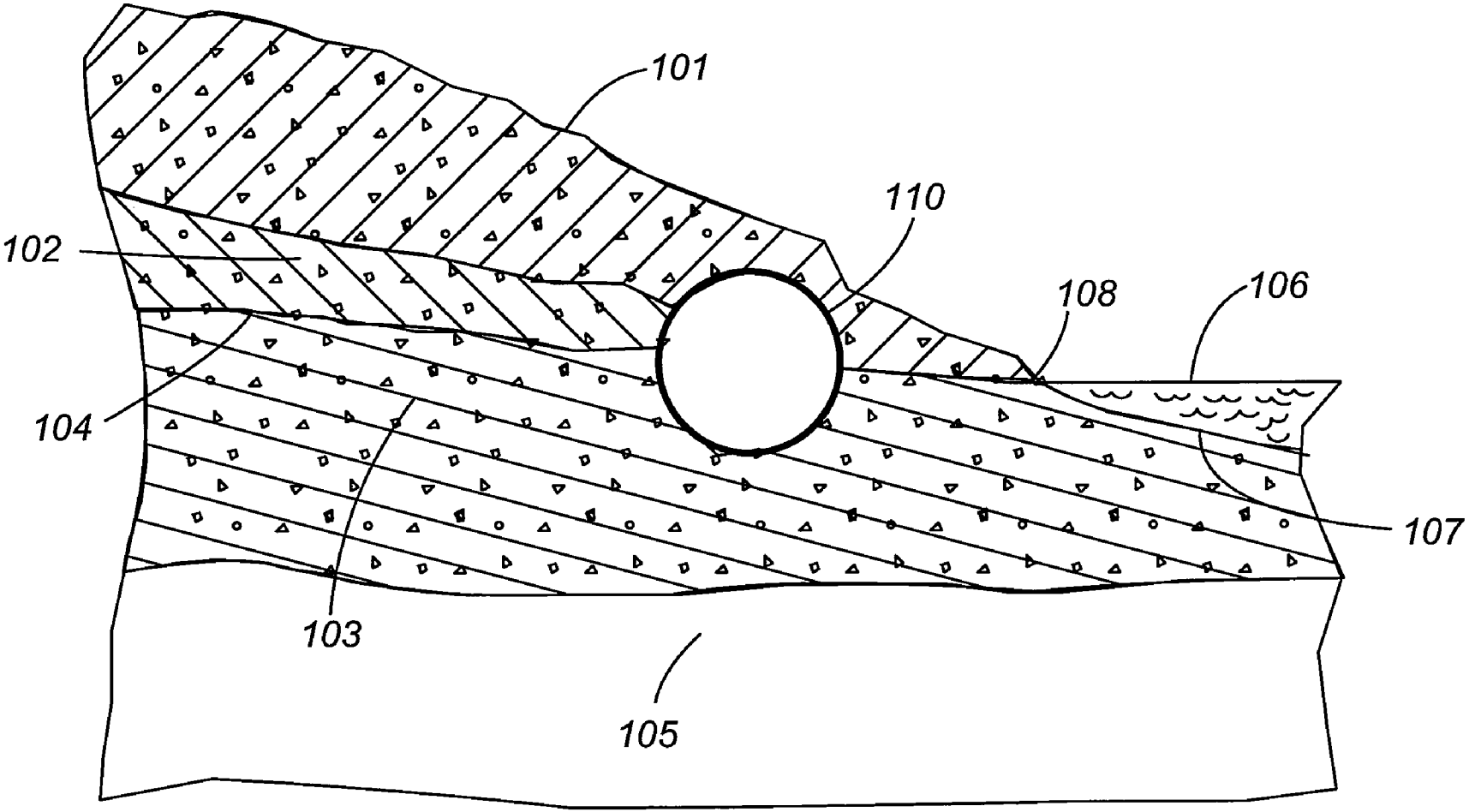
FIG. 1 is a schematic end view of a tunnel-barrier oil recovery system for oil.

FIG. 1 is a schematic end view of a tunnel-barrier oil recovery system for oil. This example shows a sand dune 101 interfacing with a body of water 106. The sand dune overlies a basement formation 105. A water table 103 in the sand is shown dipping or sloping downwards toward and joining the body of water 106 with the surface of the sand 107 descending under the water 106. An oil layer 102 in the sand overlies the water table 103 and forms an oil-water interface 104. A lined tunnel 110 is shown installed near the water shoreline 108 and running approximately parallel to the shoreline 108. The lined tunnel 110 is installed such that it approximately bisects the oil-water interface 104 where the tunnel 110 forms a physical barrier to the further migration of the oil 102 to the water body 106 or to the sand near the shoreline. The tunnel 110 is thus in a position to intercept and drain the oil 102 from the sand while not draining significant water from the water table 103.

The tunnel 110 is preferably formed by a concrete liner but the liner may be formed from other materials such as for example corrugated steel sections. The liner is preferably installed by a soft ground tunnel boring machine such as an earth pressure balance machine or even more preferably by a slurry machine. These machines are known to be able to successfully tunnel in sand or saturated sands under external fluid pressures as high as about 10 to 15 bars, depending on the seal design between the TBM and the liner segments being installed. As can be appreciated, the liner is preferably formed by bolted and gasketed segments which seal the inside of the tunnel from the external fluids and pressures. Alternately, the tunnel liner may be formed by extrusion of concrete as is known in the art. The tunnel liner may be sealed by other known methods such as for example by applying a thin layer of flexible shotcrete to the inside wall of the tunnel liner 110. The tunnel inside diameter is preferably in the range of about 3 to 15 meters depending on the nature of the oil-water interface. The tunnel liner wall thickness is preferably in the range of 40 to 300 mm depending on the depth of the oil-water interface and external fluid pressures. The tunnel barrier is typically long enough to intercept the entire length of the oil layer to be recovered. The tunnel may have a length in the range of about half a kilometer to several kilometers depending on the length of the oil layer 102 or the desired length of the oil layer to be drained.

Figure 2:
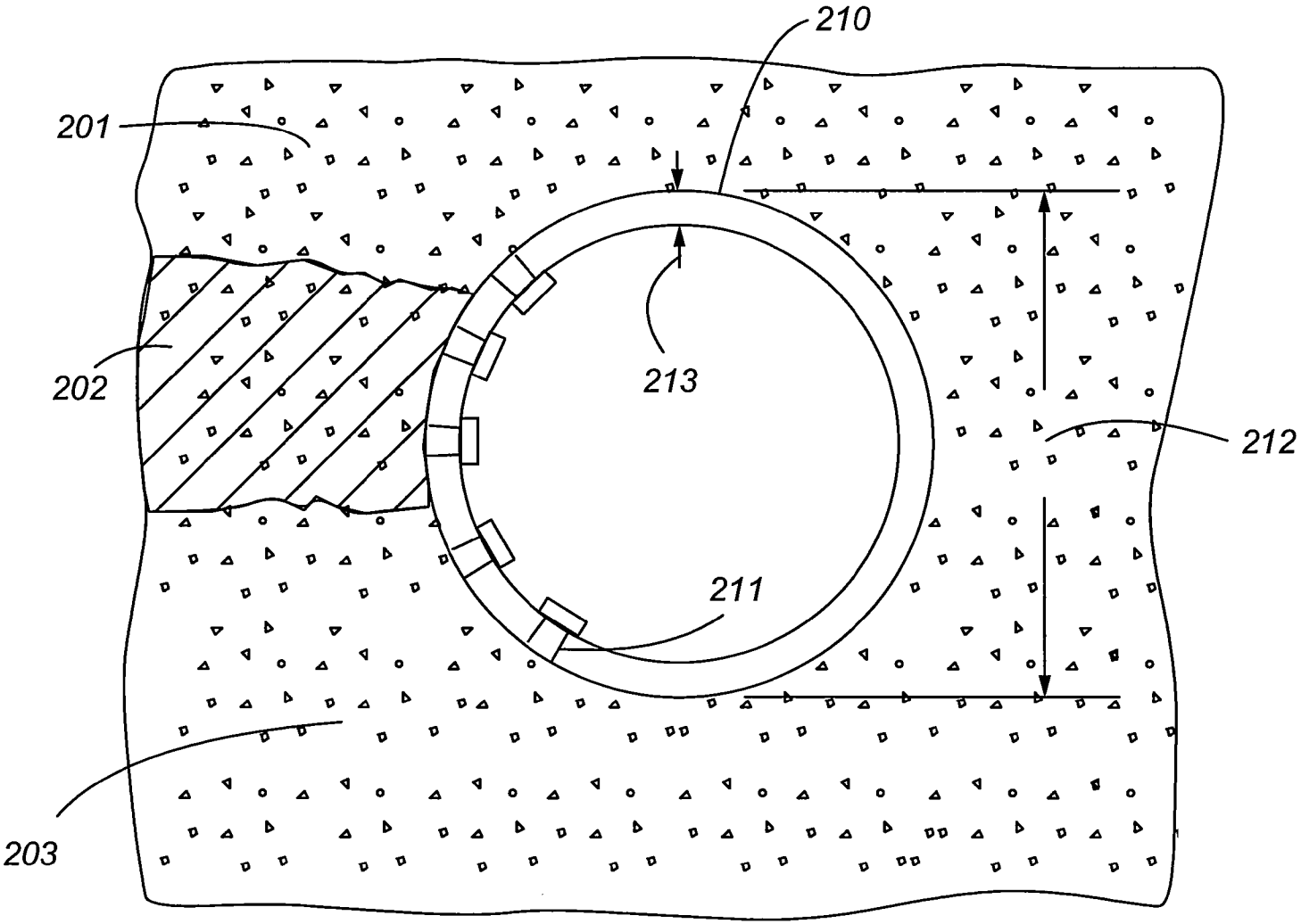
FIG. 2 is a schematic end view of a lined tunnel and oil collection ports.

FIG. 2 is a schematic end view of a lined tunnel and oil collection ports and illustrates how the tunnel, which forms a barrier, can selectively drain off oil overlying water. A cross-sectional end view of tunnel liner 210 is shown taken through a section where drain ports 211 are installed in the tunnel liner 210. The tunnel 210 is shown installed in a sand formation where the sand in layer 201 has no fluids, the sand in layer 202 contains oil to be recovered and the sand in layer 203 contains water such as for example from an aquifer or water table. Typically the oil is lighter than the water and so forms a layer above the water. The flow into the tunnel through drain ports 211 is controlled by a system described more fully in FIG. 4. The objective of the tunnel is to act as a physical barrier to the further migration of oil down the dip as shown in FIG. 1 and to further act as a collection system capable of draining all or a substantial portion of the oil from the oil-impregnated layer 202 by draining the oil through ports that communicate with the oil-impregnated sand 202 while leaving the ports in communication with the water-impregnated sand 203 and the ports in communication with the dry sand 201 closed. As can be appreciated, the tunnel is installed so as to keep the oil-impregnated layer 202 fully blocked by the tunnel liner 202 so that as many ports as possible are in communication with the oil-impregnated sand 202.

The tunnel outside diameter 212 is preferably in the range of about 4 to 16 meters depending on the nature of the oil-water interface. The tunnel liner wall thickness 213 is preferably in the range of 40 to 300 mm depending on the depth of the oil-water interface and external fluid pressures. The recovery port diameters are in the range of about 25 mm to about 300 mm depending on the size of the tunnel, the amount of oil to be recovered and the oil recovery rate that can be handled efficiently. The number of recovery ports 211, at any section through the tunnel where oil is to be collected, is in the range of about 5 to about 50 depending on the size of the tunnel and the port diameters. The diameter and spacing of ports around the liner circumference may be uniform or they may be variable in size and spacing depending again on such factors as the size of the tunnel, the amount of oil to be recovered and the oil recovery rate that can be handled efficiently.

Figure 3:
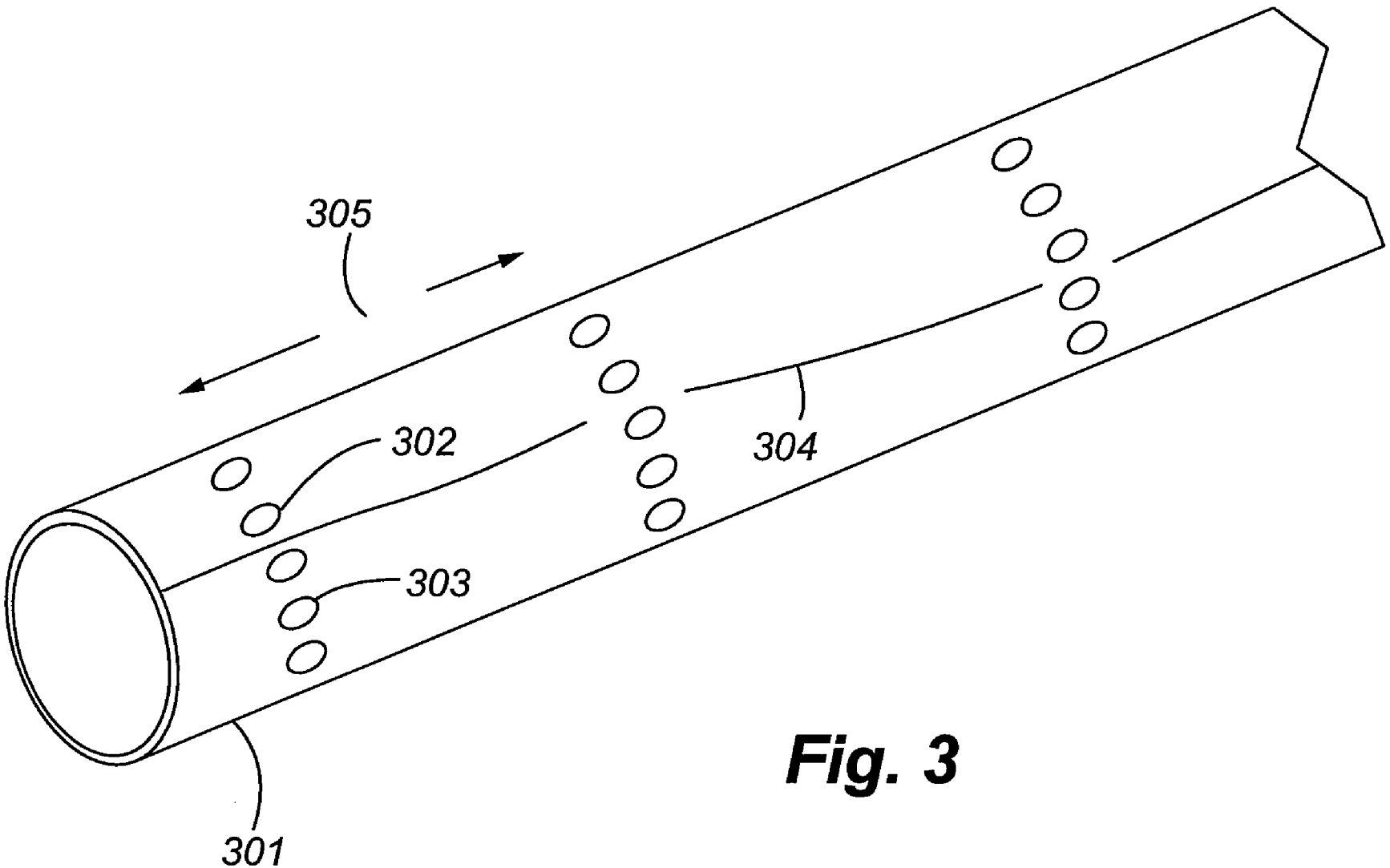
FIG. 3 is an isometric schematic showing distribution of collection ports along the tunnel.

FIG. 3 is an isometric schematic showing a possible distribution of collection ports along the tunnel. The tunnel liner 301 is shown with an example of an oil-water interface 304 contacting the tunnel liner 302 along a variable line preferably near the spring line of the tunnel (the spring line, not shown here, is the imaginary horizontal plane separating the top half of the tunnel from the bottom half of the tunnel). As can be seen, some recovery ports 302 are above the oil-water interface 304 and some recovery ports 303 are below the oil-water interface 304. The objective of the present invention is typically to recover the oil and not the water below the oil or the air above the oil. Recovery ports are installed in the tunnel liner 301 preferably around a half-diameter on the side of the tunnel the liner to which the oil flows toward as it migrates downward along the approximate dip of the formation. The recovery ports are preferably placed around liner from the about the bottom of the tunnel to about the top of the tunnel. The placement of recovery port groupings along the tunnel are shown by a separation 305. The spacing 305 is in the range of about 5 meters to about 100 meters along the length of the tunnel. The spacing is determined in part by the porosity and permeability of the sand, the viscosity of the oil, the size of the tunnel, the amount of oil to be recovered, the oil recovery rate that can be handled efficiently and other factors such as pressure gradients in the oil impregnated sands. The tunnel barrier is typically long enough to intercept the entire length of the oil layer to be recovered. The tunnel may have a length in the range of about half a kilometer to several kilometers depending on the length of the oil layer 102 or the desired length of the oil layer to be drained. Therefore the barrier tunnel may have as many as several hundred recovery port groupings along its length. The recovery ports used to collect oil can be connected together so that recovered oil is delivered to a common oil storage facility that may be located underground with the tunnel or on the surface.

The recovery ports 302 are installed around the half circumference of the tunnel liner 301 for various reasons. For example, due to the long tunnel length the position of the oil-water interface 304 will vary along the length of the tunnel due to differences in formation composition and subsurface pressures. The position of the interface 304 at any selected location along the tunnel is therefore frequently unknown. As the oil and/or water is removed from the interface 304, at the selected tunnel location the position of the interface 304 will vary over time. Accordingly, forming a plurality of spaced-apart recovery ports 302 around half of the circumference of the tunnel liner can be important to the effective operation of the tunnel in removing oil from an aquifer or dipping reservoir.

Figure 4:
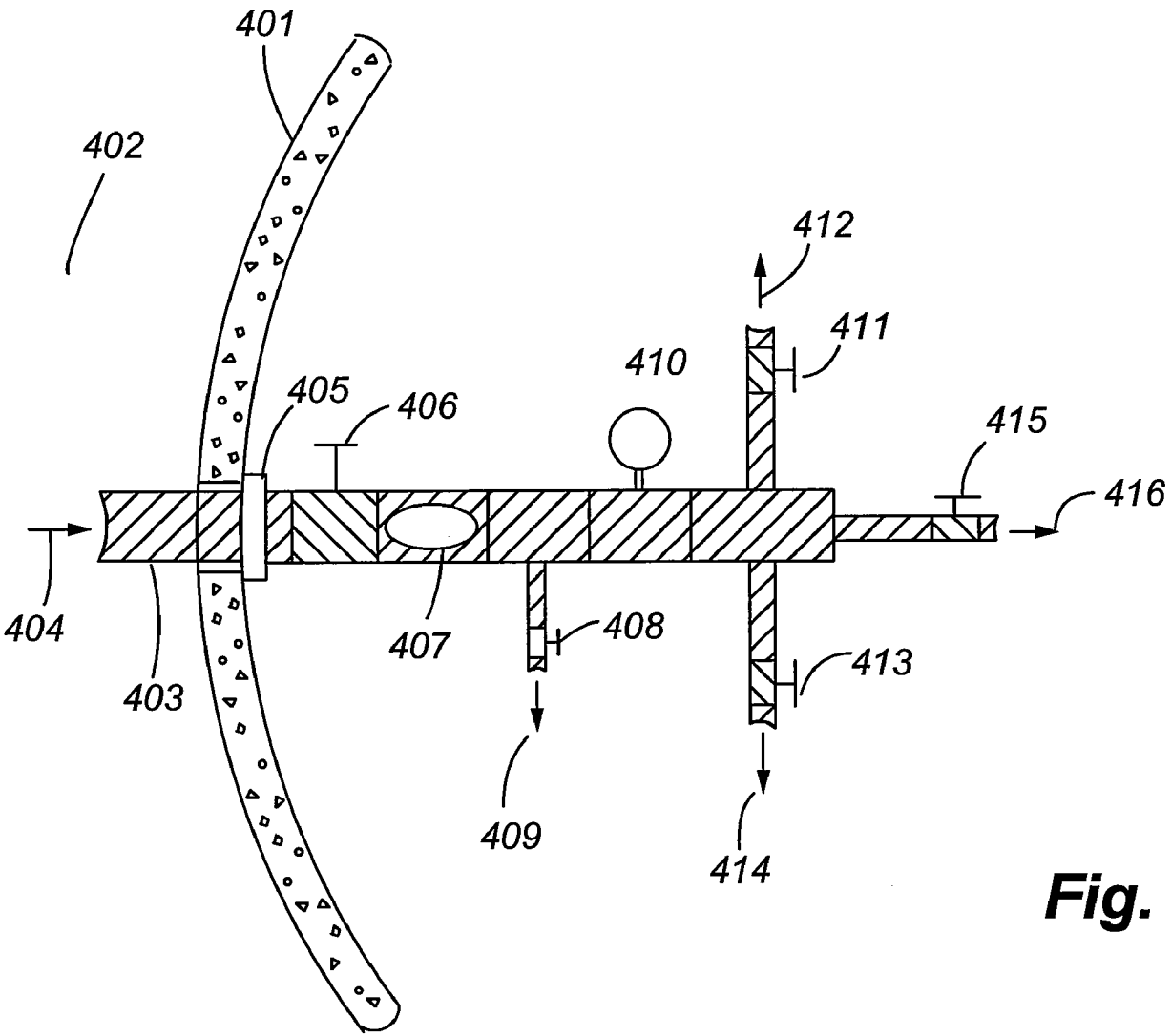
FIG. 4 illustrates one of a number of methods of determining the nature of the collected fluid and then collecting the oil.

FIG. 4 illustrates an example of a method of determining the location of the interface 304 and collecting the oil. A tunnel liner 401 is shown along with a typical recovery port 403. The recovery port may be flush with the outside of the tunnel liner 401 or it may extend some distance into the formation (for example, to penetrate a layer of grout, not shown in this figure, around the tunnel liner 401). The recovery port may even be a short slotted cased well drilled into the formation to increase the amount and rate of oil recovery. Such a well may be, for example, in the range of about 25-mm diameter to about 300 mm diameter and have a length in the range of about 1 meter to about 15 meters. The oil to be recovered enters the recovery port 403 as shown by arrow 404. The recovery port 403 is secured and sealed to the tunnel liner 401 by, for example, a flange assembly 405. The first section of a recovery plumbing assembly (which may also be called a well-head assembly) houses a main shut off valve 406 which can shut the recovery port off completely for example if it is communicating only with water or air and not the desired oil to be recovered.

The next section houses a window or viewing port 407 which may optionally be used to determine visually the nature of the fluid entering the recovery port 403. For example, if the fluid is predominantly oil, it will be light brown to black fluid. If the fluid is predominantly water, it will be light brown to clear fluid. If the fluid is predominantly air, it will be a light to clear fluid either with many entrained bubbles or little or no liquid content. The next section houses a sampling tap controlled by a valve 408 and can be optionally used to collect a sample of the recovered fluid 409 for further testing and analysis of the fluid entering the recovery port 403. The next section houses a sensor 410 which may optionally be used to determine, by measurement, the nature of the fluid entering the recovery port 403. Examples of such sensors include hygrometers, infra-red sensors, spectral sensors or specialized flow meters such as for example Coriolis flow sensors. As can be appreciated any combination of the above detection and discrimination methods may be used.

The next section houses a manifold for directing the recovered fluid. If the recovered fluid is oil as determined by visual inspection, sampling or sensor, it is directed to an oil storage facility as shown by arrow 416 by opening valve 415 and closing valves 411 and 413. If the recovered fluid is water as determined by visual inspection, sampling or sensor, it may be directed to a water storage facility as shown by arrow 414 by opening valve 413 and closing valves 411 and 415, or the water may not be recovered by shutting the main valve 406 as well as all other valves 408, 411, 413 and 415. If the recovered fluid is air as determined by visual inspection, sampling or sensor, it may be directed to a surface vent as shown by arrow 412 by opening valve 411 and closing valves 413 and 415, or the air may not be recovered by shutting the main valve 406 as well as all other valves 408, 411, 413 and 415.

As can be appreciated, the recovery port may require a filter or screen to prevent sand from entering along with the recovered fluid represented by arrow 404. Any number of sand filtering techniques may be used such as for example a length of slotted pipe that is capped in the formation. Slotted pipe is typically made from a steel tubing with long narrow slots formed into the tubing wall. The slots are approximately 150 millimeters long and about 0.3 millimeters wide. The narrow width of these slots is dictated by the requirement to prevent sand from entering into the slot when fluids are being collected. Alternately, a screen may be used in the recovery port 403 and may be installed, for example, in the flange assembly 405. The screen mesh would have openings approximately in the range of the slot widths used in the slotted pipe described above.

Along with the description of recovery presented in FIGS. 1 through 4, it is appreciated that the oil to be recovered flows in part by gravity and in part by a pressure gradient from its highest level in the reservoir to its lowest level at the collection ports. Additionally, a partial vacuum may be applied to the collection ports to enhance the pressure gradient. The collection system could also be adapted to separate produced oil from produced water.

The tunnel can also be used for biosparging, which is blowing air or oxygen at low flow rate into the water below the oil to "polish" remaining low concentrations of hydrocarbons by (1) giving oil-eating bacteria oxygen an opportunity to work and (2) volatilizing light fractions. If the air or oxygen is blown at a high enough pressure and/or flow rate, it can strip out the hydrocarbon by volatilization. This technique is called air-sparging. In some cases, bio-sparging would be the preferred technique while in others air-sparging would be the preferred technique. The bio-sparging or air-sparging could be carried out, for example, by closing valves 411, 413 and 415 and then attaching an air or oxygen line to the air removal line (shown with arrow 412). Then by opening valve 411, the bio-asparging or air-asparging treatment could be carried out by injecting air or oxygen at the desired pressure and/or flow rate. As can be appreciated any bio-asparging or air-asparging treatment would be carried out using a port that is below the oil layer 202 and in the water zone 203 as described in FIG. 2.

A number of variations and modifications of the invention can be used. As will be appreciated, it would be possible to provide for some features of the invention without providing others. For example, it would be possible to employ the present invention of a physical barrier tunnel with collection ports in a dipping oil reservoir where the tunnel blocks the entire lower end of the producing zone and is used to collect all the oil migrating downward approximately along the dip towards the tunnel barrier. As another example, it would be possible to employ the present invention of a physical barrier tunnel with collection ports in a slightly dipping heavy oil or bitumen reservoir. In the case of some heavy oil deposits, the heavy oil will flow slowly and can be recovered by well-known cold flow production. In other cases, the heavy oil or bitumen may be mobilized by application of thermal techniques (such as for example Steam Assisted Gravity Drain also known as SAGD) or diluent additives (such as for example the VAPEX process). The tunnel can be installed at the bottom of the hydrocarbon deposit on or slightly into the underlying formation to form a physical barrier and used to collect all the mobilized hydrocarbons migrating downward approximately along the dip towards the tunnel barrier.

The present invention, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, for example for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for recovering a liquid hydrocarbon, comprising:

(a) forming a barrier excavation along a substantial length of a subsurface liquid hydrocarbon-water interface, wherein the hydrocarbon-water interface is in a hydrocarbon-containing formation, wherein the formation has a thickness, wherein the barrier excavation has an inside diameter ranging from about 3 to about 15 meters, and wherein the formation thickness is less than the barrier excavation diameter such that the barrier excavation blocks substantially fluid flow in the formation;

(b) positioning a liner in the excavation, the liner being substantially impervious to the passage of the liquid hydrocarbon and water;

(c) forming a plurality of recovery ports at selected intervals along a length of the liner, the recovery ports passing through the liner and being in communication with an external subsurface formation; and (d) recovering a portion of the liquid hydrocarbon through at least some of the recovery ports.

2. The method of claim 1, wherein, at a selected location along the liner, a number of recovery ports are formed, the recovery ports being spaced along a portion of the circumference of the liner and wherein a length of the barrier excavation is sufficient to intercept substantially an entire length of the subsurface liquid hydrocarbon-water interface.

3. The method of claim 2, wherein, at the selected location, a first set of the recovery ports are below the interface and a second set of the recovery ports are above the interface.

4. The method of claim 3, wherein, during a selected time interval, the first set of recovery ports is closed while the second set of recovery ports is open, whereby the liquid hydrocarbon is recovered from the second set of recovery ports while water is not recovered from the first set of recovery ports.

5. The method of claim 2, wherein the portion of the liner circumference is approximately a half-diameter of the liner, wherein the portion of the liner circumference is adjacent to the interface, and wherein the tunnel length extends beyond the interface.

6. The method of claim 1, wherein, in the recovering step, a vacuum is applied at the number of recovery ports to draw the liquid hydrocarbon into the ports.

7. The method of claim 1, further comprising:

sparging an oxygen-containing gas through at least some of the recovery ports into the external subsurface formation, whereby the sparged oxygen-containing gas is at least one of consumed by hydrocarbon-eating bacteria and volatilizes light hydrocarbon fractions.

8. The method of claim 1, wherein, during a selected time interval, a first set of recovery ports are open and recovering the portion of the liquid hydrocarbon and a second, different set of recovery ports are open and recovering at least one of water and air and wherein the liquid hydrocarbon and at least one of water and air are directed to differing locations.

9. The method of claim 8, wherein the first and second ports are open simultaneously.

10. The method of claim 1, wherein the barrier excavation collects substantially all of the liquid hydrocarbon flowing naturally along a dip of a hydrocarbon deposit towards the barrier excavation.

11. A system for removing a liquid hydrocarbon, comprising:

(a) a tunnel extending along a length of a subsurface interface between a liquid hydrocarbon and water, wherein the hydrocarbon-water interface is in a hydrocarbon-containing formation and wherein the formation has a thickness;

(b) a liner positioned in the tunnel, the liner being substantially impervious to the passage of liquid hydrocarbons and water, wherein the liner has an inside diameter ranging from about 3 to about 15 meters; and (c) a plurality of recovery ports at selected intervals along a length of the liner, the recovery ports passing through the liner and being in communication with an external subsurface formation comprising the liquid hydrocarbon and water, wherein the formation thickness is less than the barrier excavation diameter such that the barrier excavation blocks substantially fluid flow in the formation.

12. The system of claim 11, wherein each of the recovery ports comprises:

a first section comprising a main shut off valve and at least one of the following;

an additional section comprising a viewing port to determine visually a type and/or composition of fluid entering the port;

an additional section comprising a sampling tap to collect a sample of a recovered fluid; and an additional section comprising a sensor to determine, by measurement, a type and/or composition of the fluid entering the port.

13. The system of claim 12, wherein each of the recovery ports comprises the additional section comprising a viewing port to determine visually a type and/or composition of fluid entering the port.

14. The system of claim 12, wherein each of the recovery ports comprises the additional section comprising a sampling tap to collect a sample of a recovered fluid.

15. The system of claim 12, wherein each of the recovery ports comprises the additional section comprising a sensor to determine, by measurement, a type and/or composition of the fluid entering the port.

16. The system of claim 15, wherein the sensor is at least one of an hygrometer, infra-red sensor, spectral sensor, and flow meter.

17. The system of claim 11, wherein each of the recovery ports comprise a filter to inhibit sand from entering the port along with the recovered liquid hydrocarbon.

18. The system of claim 8, wherein each of a plurality of the recovery ports comprise a manifold, the manifold comprising a first valve for directing collected liquid hydrocarbon towards a selected first location and a second valve for directing collected water towards a selected second location, the first and second locations being spatially distinct.

19. A method, comprising:

(a) providing a barrier excavation along a substantial length of a subsurface liquid hydrocarbon-water interface, the barrier excavation comprising a liner in the excavation, the liner being substantially impervious to the passage of the liquid hydrocarbon and water, and a plurality of recovery ports at selected intervals along a length of the liner, the recovery ports passing through the liner and being in communication with an external subsurface formation, wherein an outside diameter of the barrier excavation ranges from about 4 to about 16 meters, wherein the hydrocarbon-water interface is in a hydrocarbon-containing formation, wherein the formation has a thickness, and wherein the formation thickness is less than the barrier excavation diameter such that the barrier excavation blocks substantially fluid flow in the formation; and (b) at a first time interval, selecting a first set of recovery ports positioned at a first location along the tunnel;

(c) determining which first members of the first set of recovery ports are currently in communication with the liquid hydrocarbon and which second members of the first set are not currently in communication with the liquid hydrocarbon; and (d) opening the first members and not the second members.

20. The method of claim 19, wherein a length of the barrier excavation is sufficient to intercept an entire length of a hydrocarbon layer comprising the liquid hydrocarbon and further comprising:

(e) at a second, later and nonoverlapping time interval, determining which third members of the first set of recovery ports are currently in communication with the liquid hydrocarbon and which fourth members of the first set are not currently in communication with the liquid hydrocarbon; and (f) opening the third members to be currently in communication with the liquid hydrocarbon but not the fourth members.

21. The method of claim 20, wherein at least one of the first members is different from at least one of the third members of the first set opened in step (f).

22. The method of claim 20, further comprising:

(g) at a third later and nonoverlapping time interval, biosparging an oxygen-containing gas through at least some of the recovery ports into the external subsurface formation.

23. The method of claim 19, wherein sets of recovery ports are spaced along a at selected intervals along a length of the tunnel, wherein the members of the first set of recovery ports are spaced along a portion of the circumference of the liner, wherein the portion of the liner circumference is approximately a half-diameter of the liner and is adjacent to the interface, wherein, at the selected location, the first set of the recovery ports are below an interface between the liquid hydrocarbon and water and a second set of the recovery ports are above the interface, wherein the tunnel length extends beyond the interface, wherein, during the first time interval, the liquid hydrocarbon is recovered from the first members while water is not recovered from the second members.

24. The method of claim 19, wherein a vacuum is applied to the opened recovery ports to draw the liquid hydrocarbon into the opened ports.

25. The method of claim 15, wherein the barrier excavation collects substantially all of the liquid hydrocarbon flowing naturally along a dip of a hydrocarbon deposit towards the barrier excavation.

26. A method for recovering a liquid hydrocarbon, comprising:

(a) forming a barrier excavation along a substantial length of a subsurface liquid hydrocarbon-water interface, wherein the barrier excavation has an inside diameter ranging from about 3 to about 15 meters;

(b) positioning a liner in the excavation, the liner being substantially impervious to the passage of the liquid hydrocarbon and water;

(c) forming a plurality of recovery ports at selected intervals along a length of the liner, the recovery ports passing through the liner and being in communication with an external subsurface formation;

(d) sparging an oxygen-containing gas through at least some of the recovery ports into the external subsurface formation, whereby the sparged oxygen-containing gas is at least one of consumed by hydrocarbon-eating bacteria and volatilizes light hydrocarbon fractions; and (d) recovering a portion of the liquid hydrocarbon through at least some of the recovery ports.

27. A system for removing a liquid hydrocarbon, comprising:

(a) a tunnel extending along a length of a subsurface interface between a liquid hydrocarbon and water;

(b) a liner positioned in the tunnel, the liner being substantially impervious to the passage of liquid hydrocarbons and water, wherein the liner has an inside diameter ranging from about 3 to about 15 meters; and (c) a plurality of recovery ports at selected intervals along a length of the liner, the recovery ports passing through the liner and being in communication with an external subsurface formation comprising the liquid hydrocarbon and water, wherein each of the recovery ports comprises:

a first section comprising a main shut off valve; and an additional section comprising a viewing port to determine visually a type and/or composition of fluid entering the port.

28. A system for removing a liquid hydrocarbon, comprising:

(a) a tunnel extending along a length of a subsurface interface between a liquid hydrocarbon and water;

(b) a liner positioned in the tunnel, the liner being substantially impervious to the passage of liquid hydrocarbons and water, wherein the liner has an inside diameter ranging from about 3 to about 15 meters; and (c) a plurality of recovery ports at selected intervals along a length of the liner, the recovery ports passing through the liner and being in communication with an external subsurface formation comprising the liquid hydrocarbon and water, wherein each of the recovery ports compnses:

a first section comprising a main shut off valve; and an additional section comprising a sampling tap to collect a sample of a recovered fluid.

29. A method, comprising:

(a) providing a barrier excavation along a substantial length of a subsurface liquid hydrocarbon-water interface, the barrier excavation comprising a liner in the excavation, the liner being substantially impervious to the passage of the liquid hydrocarbon and water, and a plurality of recovery ports at selected intervals along a length of the liner, the recovery ports passing through the liner and being in communication with an external subsurface formation, wherein an outside diameter of the barrier excavation ranges from about 4 to about 16 meters; and (b) at a first time interval, selecting a first set of recovery ports positioned at a first location along the tunnel;

(c) determining which first members of the first set of recovery ports are currently in communication with the liquid hydrocarbon and which second members of the first set are not currently in communication with the liquid hydrocarbon;

(d) opening the first members and not the second members, wherein a length of the barrier excavation is sufficient to intercept an entire length of a hydrocarbon layer comprising the liquid hydrocarbon;

(e) at a second, later and nonoverlapping time interval, determining which third members of the first set of recovery ports are currently in communication with the liquid hydrocarbon and which fourth members of the first set are not currently in communication with the liquid hydrocarbon;

(f) opening the third members to be currently in communication with the liquid hydrocarbon but not the fourth members; and (g) at a third later and nonoverlapping time interval, biosparging an oxygen-containing gas through at least some of the recovery ports into the external subsurface formation.

30. A method for recovering a liquid hydrocarbon, comprising:

(a) forming a barrier excavation along a substantial length of a subsurface liquid hydrocarbon-water interface, wherein the barrier excavation has an inside diameter ranging from about 3 to about 15 meters;

(b) positioning a liner in the excavation, the liner being substantially impervious to the passage of the liquid hydrocarbon and water;

(c) forming a plurality of recovery ports at selected intervals along a length of the liner, the recovery ports passing through the liner and being in communication with an external subsurface formation; and (d) recovering a portion of the liquid hydrocarbon through at least some of the recovery ports, wherein, during a selected time interval, a first set of recovery ports are open and recovering the portion of the liquid hydrocarbon and a second, different set of recovery ports are open and recovering at least one of water and air and wherein the liquid hydrocarbon and at least one of water and air are directed to differing locations.

31. The method of claim 30, wherein the first and second ports are open simultaneously.

32. A system for removing a liquid hydrocarbon, comprising:

(a) a tunnel extending along a length of a subsurface interface between a liquid hydrocarbon and water;

(b) a liner positioned in the tunnel, the liner being substantially impervious to the passage of liquid hydrocarbons and water, wherein the liner has an inside diameter ranging from about 3 to about 15 meters; and (c) a plurality of recovery ports at selected intervals along a length of the liner, the recovery ports passing through the liner and being in communication with an external subsurface formation comprising the liquid hydrocarbon and water, wherein each of a plurality of the recovery ports comprise a manifold, the manifold comprising a first valve for directing collected liquid hydrocarbon towards a selected first location and a second valve for directing collected water towards a selected second location, the first and second locations being spatially distinct.

* * * * *